US006098848A

United States Patent [19]

Kawashima et al.

[11] Patent Number: 6,098,848

[45] Date of Patent: Aug. 8, 2000

[54] METHOD AND APPARATUS FOR CONNECTING A FLUID RESERVOIR WITH PIPELINES

[75] Inventors: Tsutomu Kawashima; Koji Ueda; Tsugio Saito; Kenji Kageyama, all of Tokyo, Japan

[73] Assignees: Nisso Engineering Co., LTD; Kanto Kagaku Kabushiki Kaisha, both of Tokyo, Japan

[21] Appl. No.: 09/216,119

[22] Filed: Dec. 18, 1998

[30] Foreign Application Priority Data

Dec. 25, 1997 [JP] Japan ..... 9-366302

[51] Int. Cl.[7] ..... B67D 5/00

[52] U.S. Cl. ..... 222/144.5; 222/94; 222/400.7; 137/208; 137/212

[58] Field of Search ..... 222/394, 400.7, 222/94, 144.5; 137/206, 208, 209, 212; 141/67, 285, 289, 309

[56] References Cited

U.S. PATENT DOCUMENTS

| | | | |
|---|---|---|---|
| 667,301 | 2/1901 | Dredge | 222/144.5 |
| 1,203,117 | 10/1916 | Jacovatos | 222/144.5 |
| 1,642,623 | 9/1927 | Niven | 222/144.5 |
| 1,964,362 | 6/1934 | Nassif | 222/144.5 |
| 4,893,729 | 1/1990 | Iggulden et al. | 222/144.5 |
| 5,526,957 | 6/1996 | Brown et al. | 222/94 |
| 5,615,803 | 4/1997 | Hatakeyama et al. | 222/94 |

FOREIGN PATENT DOCUMENTS

| | | |
|---|---|---|
| 337031 | 6/1977 | Austria . |
| 0 548 570 | 6/1993 | European Pat. Off. . |
| 92 06 760 | 1/1992 | Germany . |
| 7-33196 | 2/1995 | Japan . |
| 789730 | 1/1958 | United Kingdom . |

*Primary Examiner*—J. Casimer Jacyna
*Attorney, Agent, or Firm*—Darby & Darby

[57] ABSTRACT

The object of the present invention is to simplify the process of connecting a reservoir for charging and discharging 2 or more fluids with a pipeline for conveying said fluid and to assist the automation of this process.

In the present invention, a reservoir, having, at its end face, 2 or more openings for fluids for charging and discharging 2 or more fluids respectively, is connected with pipelines by using a connecting means having flow paths for 2 or more fluids and, at its end face, 2 or more openings for fluids corresponding to each of the flow paths, and each of the respective fluids is passed, when by aligning the center of 1 of the openings for fluids of the reservoir end face with 1 of the openings for fluids of the connecting means end face and by linking said openings for fluids to each other, closed passage spaces are respectively formed which are common to the 1 or more other opening(s) for fluids of the reservoir end face and to the 1 or more corresponding other opening(s) of the connecting means end face respectively, and each fluid is passed via said spaces respectively.

23 Claims, 6 Drawing Sheets

1
38
40
21
20
22
39
41
7
23
25
26
PRESSURE SWITCH
24
27
28
31
37
34
36
35
29
8
32
33
9
59
58

METHOD AND APPARATUS FOR CONNECTING A FLUID RESERVOIR WITH PIPELINES

BACKGROUND OF THE INVENTION

The invention relates to a connecting means used for connecting a reservoir for charging and discharging 2 or more fluids with pipelines and for the passage of each of the respective fluids, to a method using the connecting means for connecting the reservoir with the pipelines and for the passage of each of the respective fluids and to a reservoir used therein.

In the chemical and semiconductor industries, different fluids are conveyed by means of gas or pump pressure from reservoirs, accommodating these fluids, through pipelines to places where these fluids are required.

E.g., since large amounts of very pure chemicals are used for washing, photolithography, etching and other processes in the manufacturing of integrated semiconductor circuits or liquid crystal display elements, automatic feeding devices for chemicals are used, and manufacturers of chemicals for such automatic feeding devices normally provide chemicals filled into closed reservoirs.

Different methods, such as inserting a tube for the intake of fluids into the reservoir, connecting the tube by screws, using a coupler for easy connection, etc., are used for connecting the device with the reservoir; however, all of these methods require direct manual handling of the reservoir lid when the reservoir and the feeding device are connected.

E.g., reservoirs equipped with the above-mentioned coupler (quick connector) normally have 2 such quick connectors, one for the passage of a liquid and the other for the passage of a gas. These two components are usually fitted to a position off-center at the top face of the reservoir. Therefore, when charging the reservoir and when discharging a chemical, the position and the direction of the reservoir need first to be manually adjusted and fixed inside a clean booth. Further, for the connection with the pipeline, two quick connectors need to be fixed.

Furthermore, from the point of view of operational efficiency, there are considerable problems since automation is made difficult, and even manual operation requires a degree of skill because fine adjusting is required for reservoirs made of plastic, which is the case for most reservoirs, since the position of the connector components in relation to the shape of the reservoir differs slightly from reservoir to reservoir and because only extremely small tolerances can be admitted for the connecting portion since quick connectors, due to their performance, require a perpendicular insertion, etc.

On the other hand JP, A, 7-33196 discloses a method aligning a plurality of the fluid openings of the reservoir to the respective pipelines by means of sensor.

However, it is not efficient because the openings must be respectively aligned, and its position must be respectively detected.

Consequently, the object of the present invention is to greatly improve operational efficiency by providing a connecting means for simplifying the process of connecting a reservoir for charging and discharging a fluid with pipelines for conveying said fluids, a method for the passage of fluids using said connecting means and a reservoir used therein.

SUMMARY OF THE INVENTION

Having reflected on the before-mentioned situation, the inventors of the present invention, as a result of extensive research, have discovered a technology which solves all of these problems at once.

I.e., the present invention relates to a connecting means used for connecting a reservoir, having, at its end face, 2 or more openings for fluids for charging and discharging 2 or more fluids respectively, with pipelines and for the passage of each of the respective fluids; wherein are comprised, in its interior, 2 or more corresponding flow paths for fluids, at its end face, 2 or more openings for fluids corresponding to the flow paths and a shape, which, when the center of any of the openings for fluids of the reservoir end face is aligned with the center of any of the openings for fluids of the connecting means end face and said openings for fluids are linked to each other, respectively forms closed passage spaces which are common to the 1 or more other opening(s) for fluids of the reservoir end face and the 1 or more corresponding other opening(s) for fluids of the connecting means end face respectively.

The present invention further relates to a method for connecting a reservoir, having, at its end face, 2 or more openings for fluids for charging and discharging 2 or more fluids respectively, with pipelines by using a connecting means having flow paths for 2 or more fluids and, at its end face, 2 or more openings for fluids corresponding to each of the flow paths, and for the passage of each of the respective fluids; wherein by aligning the center of 1 of the openings for fluids of the reservoir end face with 1 of the openings for fluids of the connecting means end face and by linking said openings for fluids to each other, closed passage spaces are respectively formed which are common to the 1 or more other opening(s) for fluids of the reservoir end face and to the 1 or more corresponding other opening(s) of the connecting means end face respectively, and each fluid is passed via said spaces respectively.

Moreover, the present invention also relates to a reservoir used in the before-mentioned method; wherein are comprised, at the reservoir end face, 2 or more openings for fluids for charging and discharging 2 or more fluids respectively.

Thus, by means of the present invention, if the center of only one of the openings for fluids of the reservoir end face is aligned with the center of one of the openings for fluids of the connecting means, the other openings are linked automatically; as a result of which, it is possible to simplify the process of connecting the reservoir with the connecting means without requiring the troublesome exact aligning of positions by manual intervention.

According to the present invention, by aligning the center of only one of the openings for fluids of the reservoir end face with the center of one of the openings for fluids of the connecting means, the other openings for fluids are linked automatically; as a result of which, it is possible to simplify the process of connecting the reservoir with the connecting means without requiring the troublesome exact aligning of positions by manual intervention. I.e., by aligning the center of one of the openings for fluids of the reservoir end face with the center of one of the openings for fluids of the connecting means, the other flow paths for fluids are linked by the closed passage spaces which are common between the respective other openings for fluids of the reservoir and the corresponding respective other openings for fluids of the connecting means; therefore, the fine adjusting of the openings for fluids performed hitherto has become altogether unnecessary. Moreover, operability is improved because, due to the increased range of permissible deviations from the exact position, a rough alignment is sufficient. Further, in the present invention, the term fluid signifies not only liquids but fluids such as substances in gas or powder form, etc.

The present invention can be applied to reservoirs whose end face has 2 openings for fluids just as to those whose end face has 3 or more openings for fluids. Moreover, in the present invention, the term reservoir end face typically refers to the top face of a reservoir; however, if openings for fluids for charging and discharging fluids are provided at a side face or the bottom face of a reservoir, these faces are then considered to be the end faces of the reservoir. Further, the end face of members linked to the reservoir via conduits extending said reservoir are also included in the term reservoir end face of the present invention.

In a preferred embodiment of the connecting means according to the present invention, the distance(s) from the center of the opening for fluids for center alignment to 1, 2 or more other openings for fluids of the connecting means end face correspond(s) to the distance(s) from the center of the opening for fluids for center alignment to 1, 2 or more other opening(s) for fluids of the reservoir end face; and when linking said openings for fluids for center alignment to each other, (a) closed passage space(s) made from (a) circular flow path(s) incorporating the other opening(s) for fluids on the concentric circle(s) whose center is in said openings for fluids are/is formed. I.e., e.g. in the case of a connecting means having 2 openings for fluids, there is basically 1 circular flow path; and in the case of a connecting means having 3 openings for fluids, there are 2 circular flow paths. These/this circular flowpath(s) are/is formed by (a) groove(s) provided at the connecting means end face; however, they/it can also be formed by (a) groove(s) provided at the reservoir end face or by grooves provided at both the reservoir end face and the connecting means end face.

In another preferred embodiment with 2 openings for fluids, a connecting means has an opening for fluids for center alignment and 1 other opening for fluids, and a shape which, when the center is aligned and the first opening for fluids is linked, the periphery of the connecting means end face being sealed, forms a closed passage space which is common to the 1 other opening for fluids of the reservoir and the 1 other opening for fluids of the connecting means. In this embodiment, the sealing member, in particular an O-ring, is preferably provided at the periphery of the connecting means end face. Thus, the desired aim can be achieved by simply providing an O-ring at the periphery of the connecting means end face.

According to the present invention, the form, size and number of the openings for fluids, etc. of the connecting means end face are basically determined by the form, size and number of the openings for fluids of the end face of the reservoir to which it is to be connected. As a rule, it is necessary that the connecting means end face has an area which can cover all the openings for fluids of the reservoir end face. It is further preferred that the openings for fluids, at the time of linking, fit to each other so that the fluid does not leak. Moreover, at the periphery of the opening for fluids for center alignment of the connecting means end face or of the opening for fluids for center alignment of the reservoir end face, the use of an O-ring is preferred to prevent the fluid from leaking at the time of linking. Further, the number of openings for fluids of the connecting means end face is typically identical to the number of openings for fluids of the reservoir end face; however, it is also possible to use a smaller or greater number of openings for fluids at the connecting means end face than at the reservoir end face.

Moreover, regarding the method for passing the different fluids by using the connecting means according to the present invention, the linking between the openings for fluids for center alignment can be performed manually; however, it is preferred to automate the linking of said openings for fluids by means of a CCD camera and an image processing device or by sensors detecting the presence of objects, such as limit switches, proximity switches, etc., while using a cylinder motor and other moving devices. Further, when using sensors, it is preferred to use air sensors since the centers of the openings for fluids can be aligned with each other, without generating contamination, while preventing corrosion in the environment to which fluids such as chemicals are exposed, by using only air jets and air pipes in the vicinity of the object to be detected.

Besides, the reservoir according to the present invention, having, at its end face, 2 or more openings for fluids for charging and discharging 2 or more fluids respectively, can have any shape provided it can be used to implement the method of the present invention; however, reservoirs having valves for maintaining 1, 2 or more opening(s) for fluids in a blocked state so as to prevent the contamination of the contents of the reservoir are preferred. In this embodiment, said valve is pushed downward when the connecting means end face is brought into contact with the reservoir end face, whereupon the fluid can flow.

Further, as reservoirs having 2 openings for fluids at their end face, reservoirs having a sealing member, in particular an O-ring, for surrounding said 2 openings for fluids, and a shape which can form a closed passage space by means of said O-ring are preferred, since thereby the aim of the present invention can easily be achieved. Moreover, as reservoir, other than reservoirs wherein the openings for fluids are located directly at the reservoir top face, e.g., reservoirs whose end face is the end face of a member which is linked to the reservoir via conduits through which the fluids pass are preferred, since they enable to perform the connecting process by remote control.

DETAILED DESCRIPTION OF THE INVENTION

Figure 1:
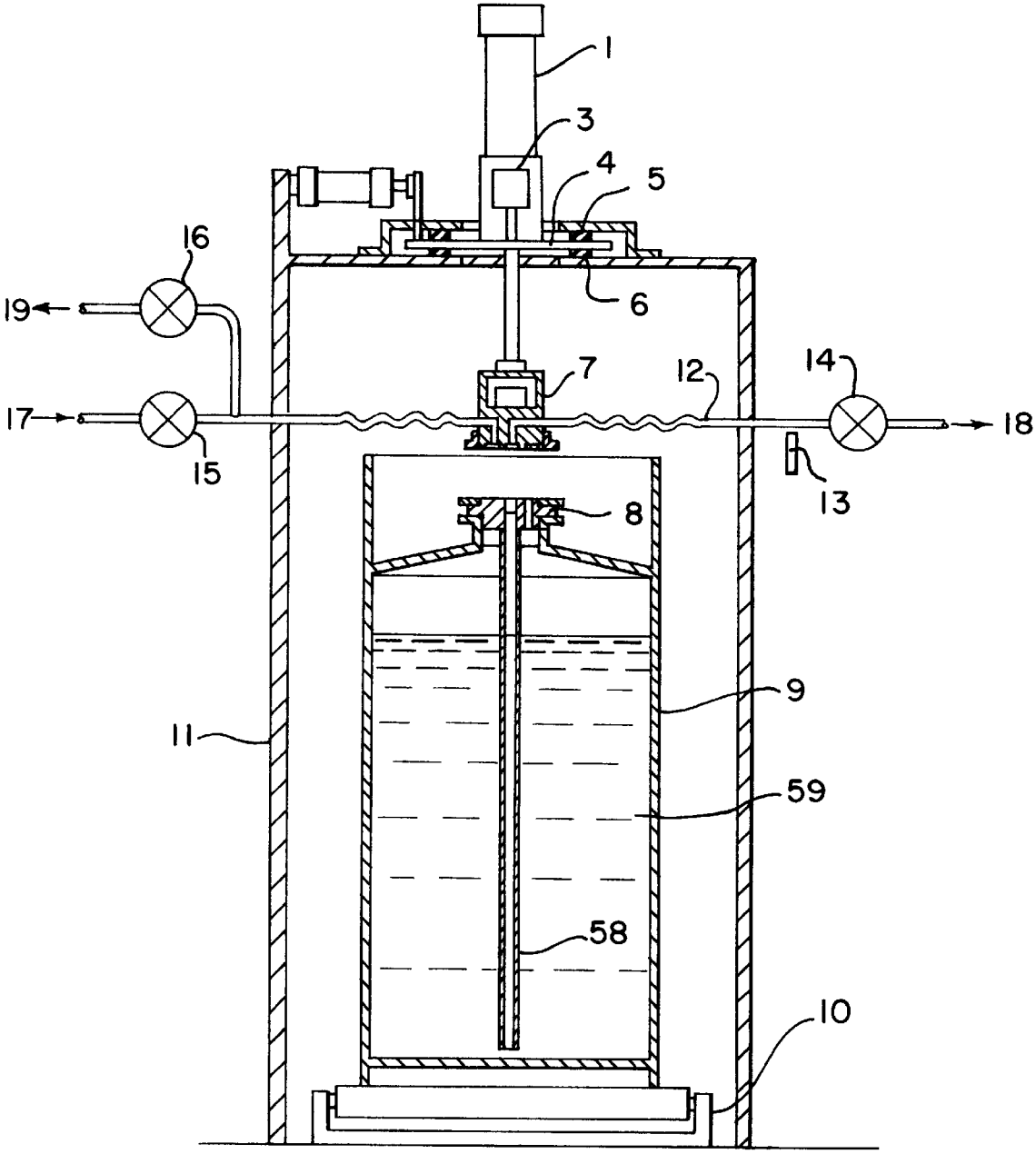
FIG. 1 shows one embodiment of a connecting means and a reservoir of a device for conveying liquids by gas pressure used in the present invention.

While hereinafter embodiments of the invention are explained in great detail by referring to the drawings, it goes without saying that the invention is not limited to this embodiment.

FIG. 1 shows the constitution of the principal parts of a device for conveying liquids by gas pressure used in the present invention.

Figure 8:
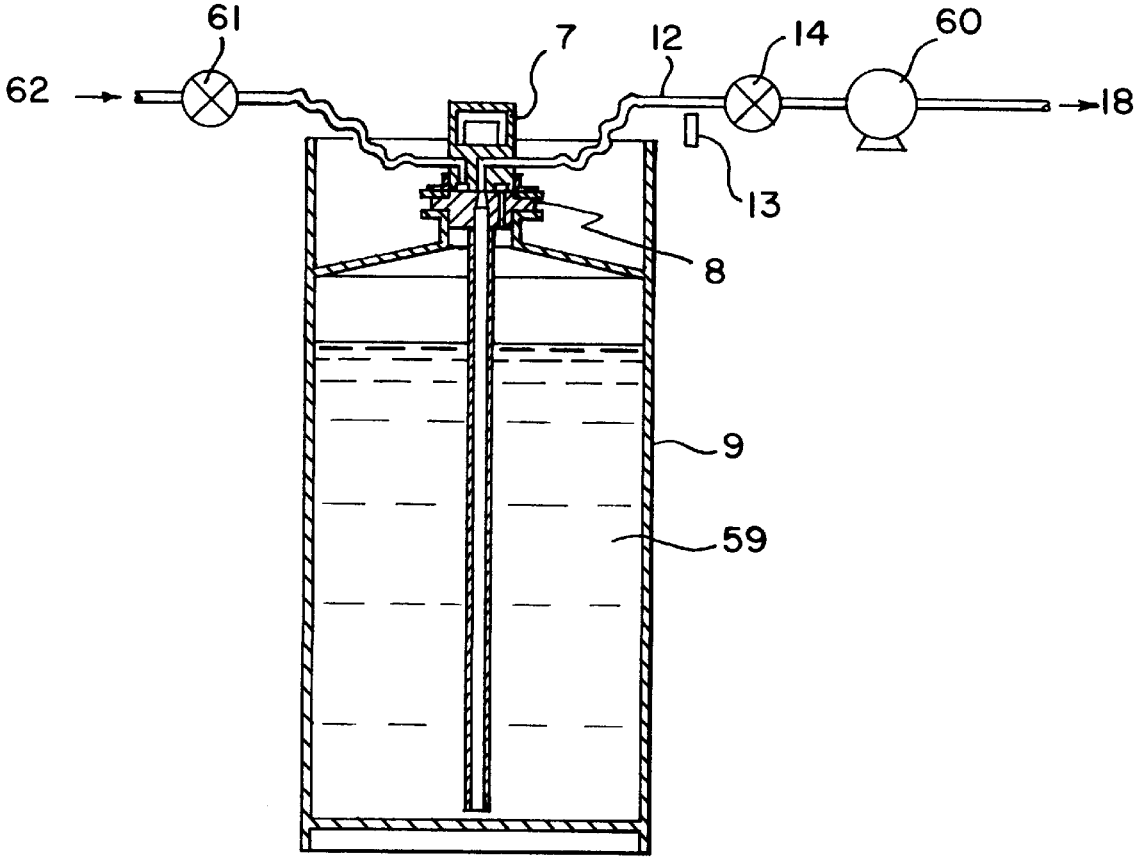
FIG. 8 shows a flow chart of a device for conveying liquids by pump pressure of one embodiment for implementing a method according to the invention.

FIG. 8 shows a flow chart of a device for conveying liquids using a pump. Only the way of taking in the liquid is different for the method of conveying liquids by gas pressure and the method for conveying liquids by means of a pump. The method of conveying the liquids and the basic constitution are identical. Therefore, the method for conveying liquids by gas pressure of FIG. 1 will be explained below.

A liquid reservoir 9 such as a chemical bottle is transported by a separate device for transporting chemical bottles 10 to a position directly below a device for conveying liquids 11. Gas 17, such as $N_2$, is fed into a liquid reservoir 9, which has previously been filled with a liquid such as a chemical, after an end face portion 8 of the liquid reservoir and a connecting means 7 of a device for conveying liquids have been joined; whereupon the liquid inside the liquid reservoir is forced out and conveyed via pipelines to the place where the liquid is used.

The end face portion 8 of the liquid reservoir, located at the top face of the liquid reservoir, is furnished with an opening for liquids and an opening for gas. Each of the connecting openings, the opening for liquids and the opening for gas, is furnished with a valve; and when the valve of the opening for liquids is closed, the opening for liquids is shut tightly.

The connecting means 7 of the device for conveying liquids is suspended from the rod tip of a Z-direction air cylinder 1 installed above a slide plate 4. An X-direction air cylinder 2 and a Y-direction air cylinder 3 for aligning the center of the connecting means 7 of the device for conveying liquids with the center of the end face portion 8 of the liquid reservoir are fitted to the slide plate 4. Loads applied to the slide plate 4 are received by a lower bearing 6 since the slide plate 4 is carried by the lower bearing 6.

The connecting parts are joined when the rod of the Z-direction air cylinder 1 is pushed downward after the center of the connecting means 7 of the device for conveying liquids has been aligned with the center of the end face portion 8 of the liquid reservoir. When the connection is made, the connecting parts are pressed against each other by the driving force of the Z-direction air cylinder 1, and the reaction force occurring at that time is received by an upper bearing 5 which is above the slide plate 4.

Figure 2:
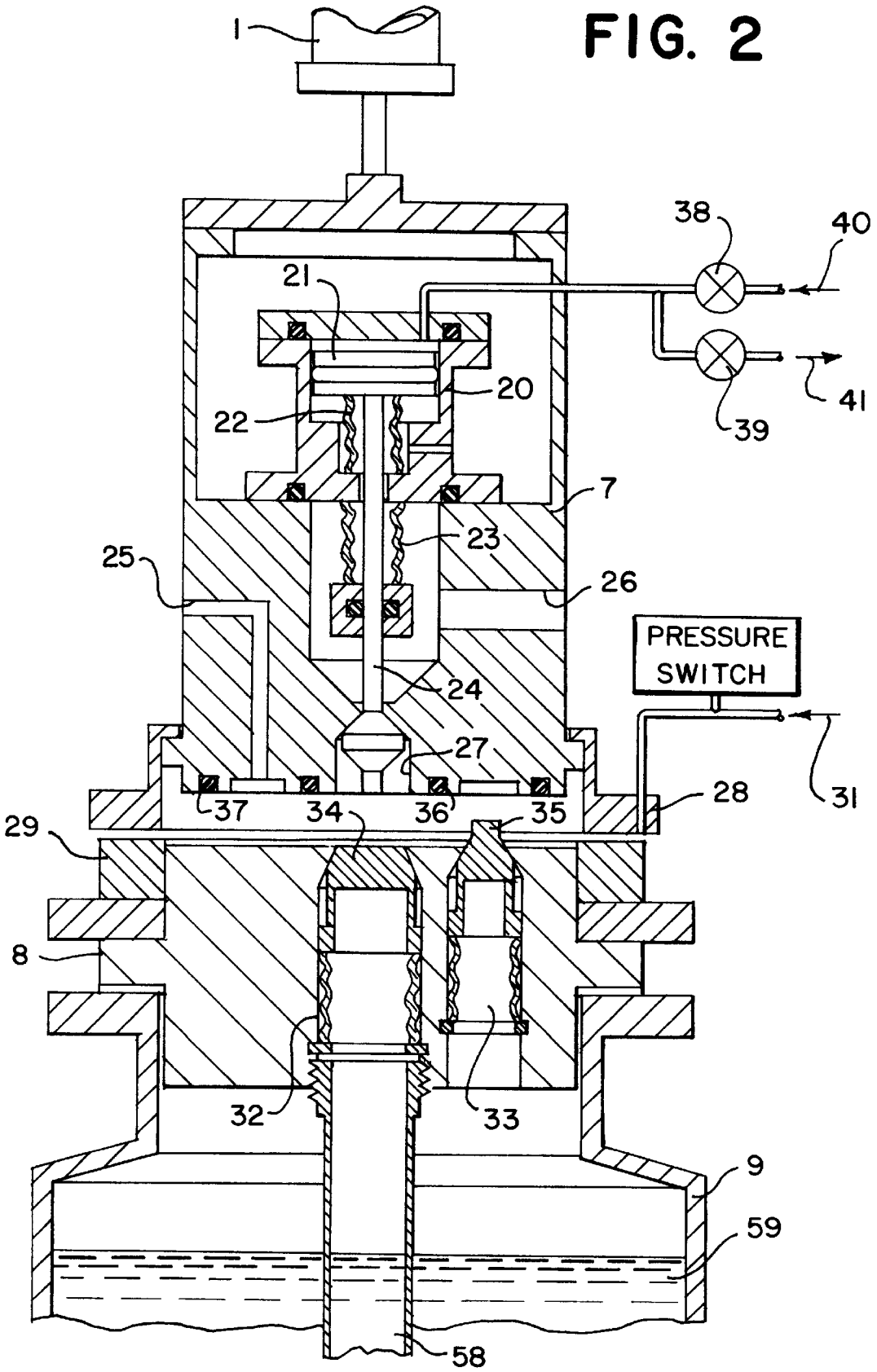
FIG. 2 shows a sectional view of a connecting means and a reservoir end face (top face portion) of one embodiment of the invention.

FIG. 2 shows the connection between the liquid reservoir 9 and the device for conveying liquids 11 in even greater detail.

(1) Centering

The alignment of the center of the connecting means 7 of the device for conveying liquids with the center of the end face portion 8 of the liquid reservoir takes place after the liquid reservoir 9 has been transported to a position directly below the device for conveying liquids 11. The connecting means 7 of the device for conveying liquids is lowered when the Z-direction air cylinder 1 above the device for conveying liquids moves forward. A centering ring 28 is fitted to the connecting means 7 of the device for conveying liquids, and a centering plate 29 is fitted to the end face portion 8 of the liquid reservoir. When the connecting means 7 of the device for conveying liquids moves downward, the downward movement comes to a halt at a position where the centering ring 28 comes into contact with the centering plate 29.

Figure 7:
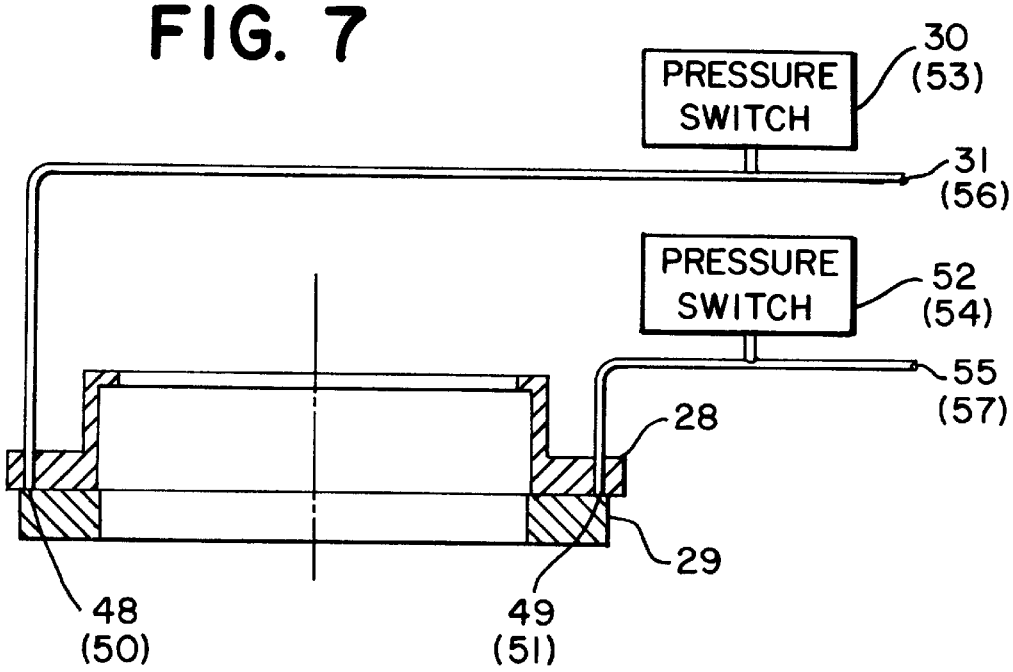
FIG. 7 shows the state of a connecting means of one embodiment of the invention when the centers are aligned during centering performed while using air sensors.

The centering ring 28 has 4 air sensor holes 48, 49, 50, 51. The outer diameter of the centering plate 29 is a little bigger than the pitch diameter of the air sensor holes 48, 49, 50, 51; and, as shown in FIG. 7, the centers are aligned when, the centering ring 28 being in contact with the centering plate 29, the 4 air sensor holes 48, 49, 50, 51 are completely blocked by the centering plate 29.

Figure 5:
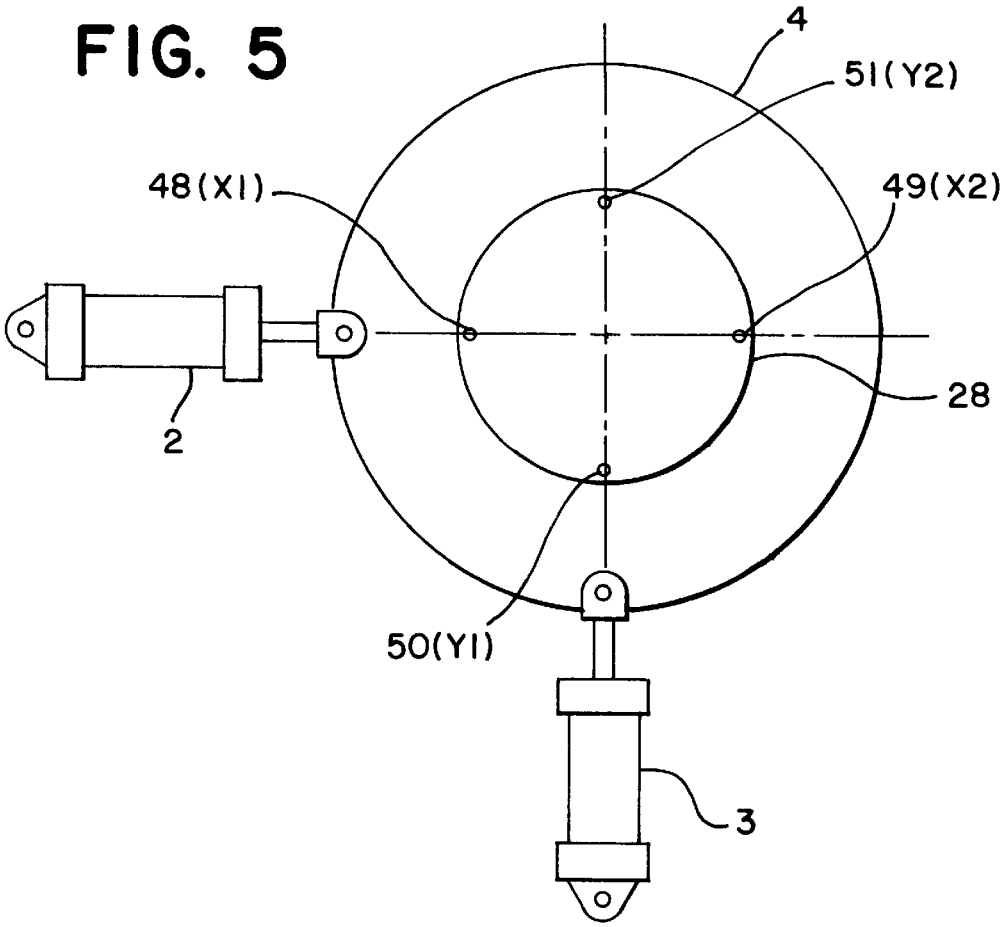
FIG. 5 shows the centering mechanism of a connecting means of one embodiment of the invention.

As shown in FIG. 5, moving the slide plate 4 by the X-direction air cylinder 2 and the Y-direction air cylinder 3, the centering ring 28 can be moved to and brought to a halt at any position in the X-Y direction.

Figure 6:
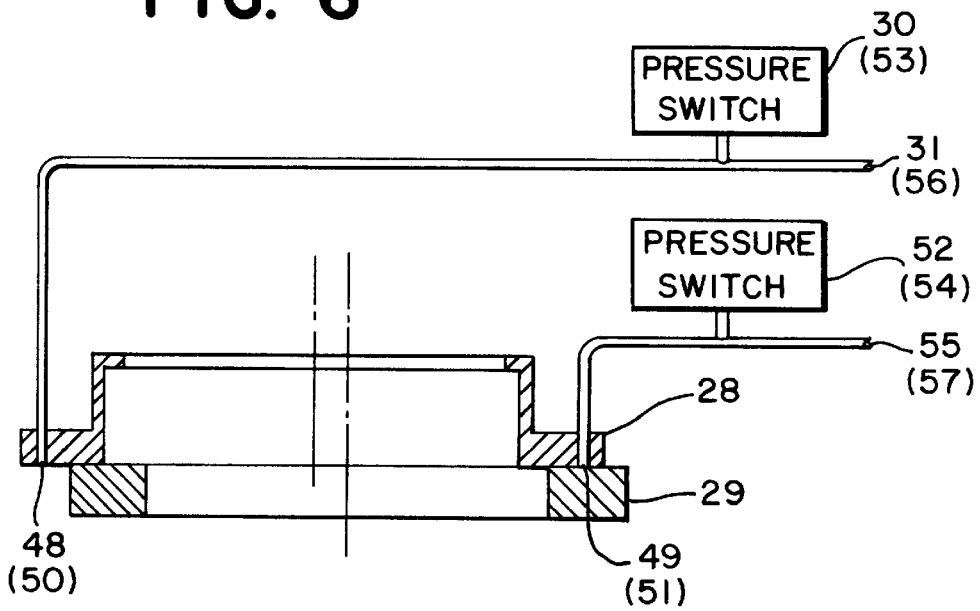
FIG. 6 shows the state of a connecting means of one embodiment of the invention when there is a deviation from the center during centering performed while using air sensors.

And as shown in FIG. 6, if there is a deviation from the center, one of the airs sensor holes X1 48, X2 49, Y1 50, Y2 51 will be open.

Air is constantly blown from the air sensor holes 48, 49, 50, 51, and since there is a difference in air pressure in the air feed path depending on whether the air sensor holes are open or blocked, the pressure differential is detected by pressure switches 30, 52, 53, 54 provided in the air feed path, and the open or closed state of the air sensor holes 48, 49, 50, 51 is detected.

Concerning the X-direction, the rod of the X-direction air cylinder 2 moves forward if X1 48 is open and pulls back if X2 49 is open.

And concerning the Y-direction, the rod of the Y-direction air cylinder 3 moves forward if Y1 50 is open and pulls back if Y2 51 is open.

Thus, the connecting means 7 of the device for conveying liquids is moved by the rods of the X-direction air cylinder 2 and the Y-direction air cylinder 3, and its center is aligned with the center of the end face portion 8 of the liquid reservoir.

(2) Pressurization by gas

After aligning the center of the connecting means 7 of the device for conveying liquids with the center of the end face portion 8 of the liquid reservoir, the rod of the Z-direction air cylinder 1 moves forward, pushing the connecting means 7 of the device for conveying liquids against the end face portion 8 of the liquid reservoir so as to be in close contact with each other.

Figure 3:
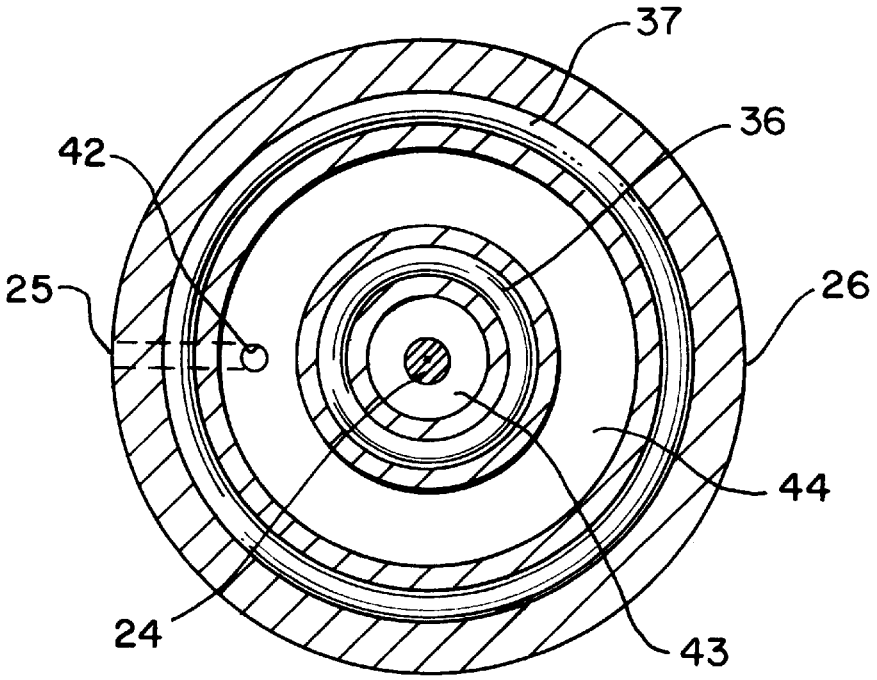
FIG. 3 shows a connecting means end face of one embodiment of the invention.
Figure 4:
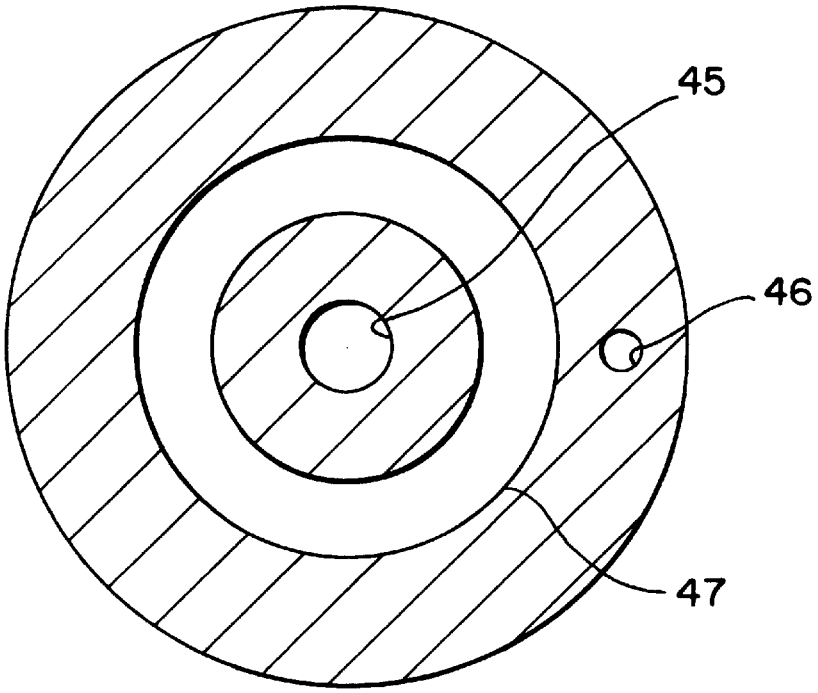
FIG. 4 shows a reservoir end face portion of one embodiment of the invention.

At this instant, as shown in FIGS. 3, 4, a gas feed opening 42 of the device for conveying liquids is joined to an opening for gas 46 of the liquid reservoir, and an opening for liquids 45 of the liquid reservoir is joined to a liquid intake opening 43 of the device for conveying liquids by an external O-ring 37 and an internal O-ring 36 fitted to the lower face of the connecting means 7 of the device for conveying liquids so as to shut out the outside air and prevent leaks from the different flow paths.

A valve 35 of the opening for gas of the end face portion of the liquid reservoir is pushed downward and opened by the concave face of a gas feed groove 44 of the lower face of the connecting means 7 of the device for conveying liquids when the connecting means 7 of the device for conveying liquids is tightly joined to the end face portion 8 of the liquid reservoir.

When a gas 17 is fed from an opening for gas 25 of the device for conveying liquids after the connecting parts have been tightly joined, the gas passes through the gas feed groove 44 of the lower face of the connecting means 7 of the device for conveying liquids, is fed from the opening for gas 46 of the end face portion of the liquid reservoir into the liquid reservoir 9 and pressurizes the interior of the liquid reservoir. By means of this gas pressure a liquid 59 inside the liquid reservoir 9 is extracted and force-fed to the place where it is used.

Since the gas feed groove 44 of the connecting means of the device for conveying liquids forms concentric circular flow paths, it is possible to feed the gas after the parts have been joined, irrespective of the bearing, between 0° and 360°, of the opening for gas on the side of the liquid reservoir at the time the parts are joined.

(3) Conveying of liquids

The interior of the liquid reservoir is pressurized by gas after the connecting means 7 of the device for conveying liquids has been tightly joined to the end face portion 8 of the liquid reservoir. The connecting means 7 of the device for conveying liquids is furnished with a valve pushing rod 24, and the upper portion of the valve pushing rod 24 is connected to a piston 21 accommodated inside a cylinder 20. The piston 21 is normally, when no air pressure is applied to the upper portion of the piston, pushed up by a spring 22 situated below the piston; also a valve for closing a liquid intake opening 43, fitted to the lower portion of the valve pushing rod, closes a liquid flow path 27 of the liquid intake opening.

Compressed air 40 is fed to the upper portion of the piston, the piston 21 is pushed by the air pressure, and when the driving force of the piston 21 overcomes the resistance of the spring 22, the piston 21 and the valve pushing rod 24 are pushed downward, and when the tip of the valve pushing rod 24 pushes a valve 34 of the opening for liquids of the liquid reservoir 9 down, the opening for liquids 45 of the liquid reservoir and the liquid flow path 27 of the liquid intake opening 43 are opened simultaneously, and the liquid 59 inside the liquid reservoir, passing a liquid intake tube 58 inside the reservoir, is forced from the opening for liquids 45 of the liquid reservoir via the liquid intake opening 43 of the device for conveying liquids into a liquid feed tube 12 by the gas pressure inside t he liquid reservoir.

The liquid feed tube 12 leads to the place where the liquid 59 is used. When the intake of the liquid is discontinued, the compressed air above the piston at the upper portion of the valve pushing rod is released. At this instant, the piston 21 is pushed upward by the driving force of the spring 22, the liquid flow path 27 of the device for conveying liquids and the valve 34 of the opening for liquids of the liquid reservoir are closed simultaneously, and the intake of the liquid is interrupted.

Thus, the liquid 59 inside the liquid reservoir can be conveyed at will to the places where the liquid is used by moving the piston 21 at the upper portion of the valve pushing rod up and down.

(4) Exchange of the liquid reservoir

When the liquid inside the liquid reservoir comes to an end, the gas for pressurizing the liquid reservoir flows into the liquid feed tube 12. The liquid feed tube 12 is furnished with a sensor 13 for detecting the presence of a liquid from the outside of the tube, and when the liquid inside the liquid feed tube comes to an end, it is judged that there is no liquid in the liquid reservoir, and the liquid reservoir 9 is exchanged. When the liquid 59 inside the liquid reservoir comes to an end, the feeding of the gas 17 is first interrupted. The air pressure above the piston at the upper portion of the valve pushing rod of the connecting means 7 of the device for conveying liquids is released, whereupon the valve 34 of the opening for liquids and the liquid flow path 27 of the liquid intake opening are closed simultaneously. At this time, gas pressure still remains inside the liquid reservoir; therefore, a gas exhaust valve 16 is opened, whereupon the gas inside the liquid reservoir is removed, and the pressure inside the liquid reservoir becomes identical to the atmospheric pressure.

Next, the Z-direction air cylinder 1 of the device for conveying liquids is lifted, and the connecting means 7 of the device for conveying liquids is separated from the end face portion 8 of the liquid reservoir. The empty reservoir is transported by the separate device for transporting liquid reservoirs 10 from a position directly below the device for conveying liquids 11, and a new liquid reservoir 9, filled with a liquid, is transported by the device for transporting liquid reservoirs 10 to a position directly below the device for conveying liquids 11. Thereafter, the centering, pressurization by gas and conveying of liquids are performed in the order described above.

Thus, it is possible to feed the necessary amount of liquid to the place where the liquid is used by providing the necessary number of liquid reservoirs 9 filled with the liquid.

Next, another embodiment of the present invention will be explained, in which the reservoir end face and the connecting means end face have 3 openings for fluids respectively, while referring to FIG. 9, 10.

Figure 10:
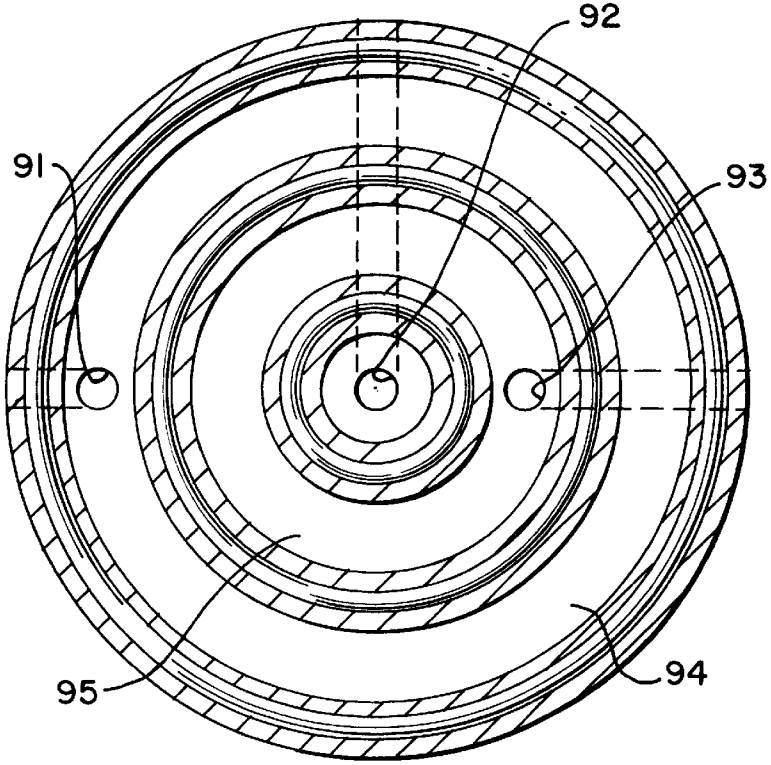
FIG. 10 shows a connecting means end face of one embodiment of the invention having 3 openings for fluids.
Figure 9:
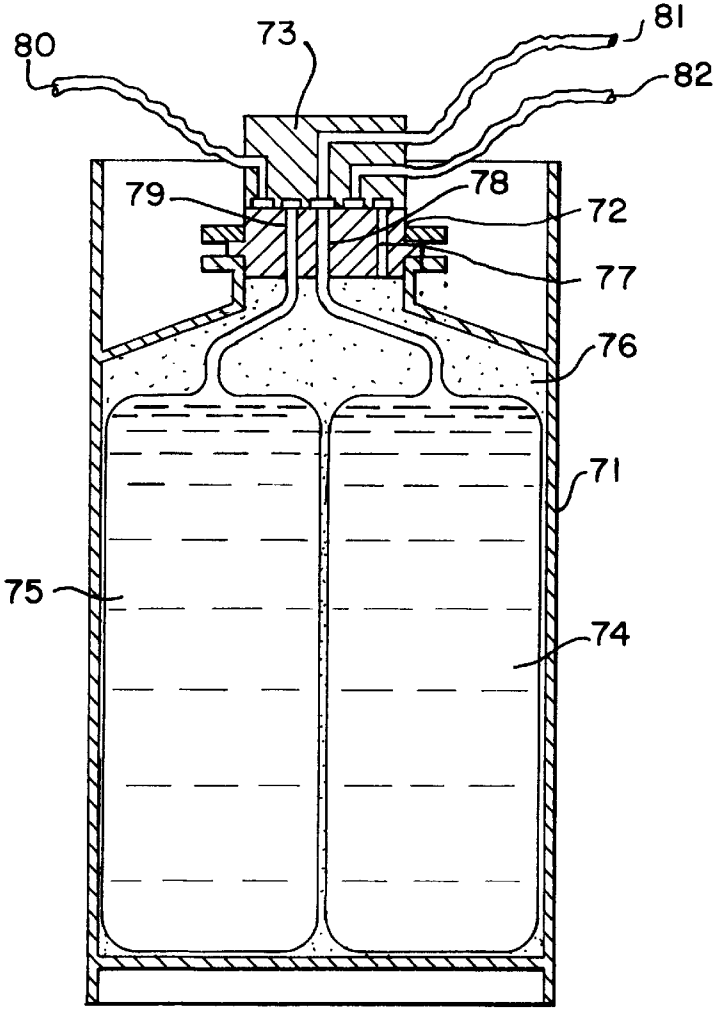
FIG. 9 shows a reservoir of one embodiment of the invention having 3 openings for fluids at its end face.

FIG. 9 shows a reservoir 71 provided with a reservoir end face portion 72 having 3 openings for fluids 77, 78, 79 for charging and discharging 3 fluids respectively, i.e. 1 gas 76 and 2 liquids 74, 75. Compared to this, FIG. 10 shows a connecting means 73 provided with a connecting means end face having openings for fluids 91, 92, 93 respectively corresponding to the openings for fluids 77, 78, 79 of the before-mentioned reservoir end face 72. When the opening for fluids 78 of the reservoir end face is centered with and fitted to the opening for fluids 92 of the connecting means end face, a closed passage space made of the circular flow path 94 which is common to the openings for fluids 77, 91 and a closed passage space made of the circular flow path 95 which is common to the openings for fluids 79, 93 are automatically formed; whereupon the passage of a gas 76 and of liquids 74, 75 can take place independently of each other. The gas pressure inside the reservoir increases by force-feeding the gas 76 from the pipeline 80, flexible bags, respectively containing the liquids 74, 75, are pressurized and the liquids 74, 75 are discharged via the pipelines 81, 82 respectively.

Thus, even with the passage of 3 fluids, each of the fluids can be easily passed by aligning the center of only 1 opening for fluids of the connecting means with the center of only 1 opening for fluids of the reservoir Similarly, in the case of the passage of 4 or more fluids, it is possible to pass each fluid by using a similar connecting means and a similar method.

As is clear from the above descriptions, the present invention, in addition to simplifying and automating the connection between a reservoir and a pipeline, contributes to factory automation and the reduction of manual labor while avoiding personal injuries due to chemicals etc.

What is claimed is:

1. A connecting means for connecting a reservoir including a reservoir end face having at least two openings for charging and discharging at least two fluids respectively, with pipelines, and for the passage of each of the respective fluids, the connecting means having an interior with at least two flow paths defined therein, comprising:

a connecting means end face having at least two openings for fluids corresponding to the at least two flow paths, the connecting means end face having a shape so that when a center of any of the openings for fluids of the reservoir end face is aligned with a center of any of the openings for fluids of the connecting means end face and the openings for fluids are linked to each other, respectively, closed passage spaces common to at least one of the openings for fluids of the reservoir end face and at least one of the corresponding other openings for fluids of the connecting means end face respectively are formed, the closed passage spaces being a circular flow path incorporating the at least one other opening for fluids on the concentric circles whose center said opening for fluids are formed.

2. The connecting means according to claim 1, wherein the distance from the center of the opening for fluids for center alignment to at least one of the other openings for fluids of the connecting means end face corresponds to the distance from the center of the opening for fluids for center alignment to at least one of the other openings for fluids of the reservoir end face; and when linking said openings for fluids for center alignment to each other, at least one closed passage space made from at least one circular flow path incorporating the other openings for fluids on the concentric circles whose center is in said openings for fluids are formed.

3. The connecting means according to claim 1, wherein the connecting means end face has an opening for fluids for center alignment and one other opening for fluids.

4. The connecting means according to claim 3, wherein the opening for fluids for center alignment is an opening for liquids and the one other opening for fluids is an opening for gas.

5. The connecting means according to claim 1, wherein the reservoir end face has an opening for fluids for center alignment and one other opening for fluids, wherein the reservoir end face has a shape which, when the center is aligned and the first opening for fluids is link, the periphery of the connecting means end face being sealed, forms a closed passage space which is common to the one other opening for fluids of the reservoir and the one other opening for fluids of the connecting means.

6. The connecting means according to claim 5, further comprising a sealing member disposed at the periphery of the connecting means end face and having a shape which forms a closed passage space by means of said sealing member.

7. The connecting means according to claim 6, wherein the sealing member is an O-ring.

8. The connecting means according to claim 5, wherein the opening for fluids for center alignment is an opening for liquids and the one other opening for fluids is an opening for gas.

9. The connecting means according to claim 1, said connecting means end face having a shape for fitting its opening for fluids for center alignment to the opening for fluids for center alignment of the reservoir end face.

10. The connecting means according to claim 1, further comprising an O-ring at the periphery of the opening for fluids for center alignment of the connecting means end face.

11. The connecting means according to claim 1, further comprising at least one valve for maintaining at least one of the openings for fluids in a blocked state.

12. The connecting means according to claim 1, further comprising sensor for center alignment.

13. The connecting means according to claim 12, wherein the sensors are air sensors.

14. The connecting means according to claim 1, wherein the opening for fluids for center alignment is located substantially at the center of the connecting means end face.

15. The connecting means according to claim 1, wherein the reservoir end face is the end face of a member which is linked to the reservoir via conduits extending from the reservoir.

16. A method for connecting a reservoir, having a reservoir end face with at least two openings for fluids for charging and discharging at least two fluids respectively, with pipelines using a connecting means having flow paths for at least two fluids and a connecting means end face at least two openings for fluids corresponding to each of the flow paths, and for the passage of each of the respective fluids, comprising the steps of:

forming closed passage spaces that are common to the at least one opening for fluids of the reservoir end face and to the at least one corresponding other openings of the connecting means end face respectively, by aligning the center of one of the openings for fluids of the reservoir end face with one of the openings for fluids of the connecting means end face and by linking said openings for fluids to one another, the closed passage spaces being a circular flow path incorporating the at least one other opening for fluids on the concentric circles whose center said opening for fluids are formed; and passing fluids via said spaces respectively.

17. The method according to claim 16, wherein center alignment is performed by sensors.

18. The method according to claim 17, wherein the sensors are air sensors.

19. A reservoir used in the method according to claim 16, wherein the reservoir end face has at least two openings for fluids for charging and discharging at least two fluids respectively.

20. The reservoir according to claim 19, further comprising at least one valve for maintaining one or more openings for fluids in the blocked state.

21. The reservoir according to claim 19, further comprising a sealing member surrounding said openings for fluids in the reservoir end face and having a shape forming closed passage spaces by means of said sealing member.

22. The reservoir according to claim 21, wherein the sealing member is an O-ring.

23. The reservoir according to claim 19, wherein the reservoir end face is the end face of a member which is linked to the reservoir via conduits extending from the reservoir.

* * * * *